US007273296B2

(12) United States Patent
Roe

(10) Patent No.: US 7,273,296 B2
(45) Date of Patent: Sep. 25, 2007

(54) BACK-TO-BACK LAMPHOLDER

(75) Inventor: Frank Roe, Wolcottville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 105 days.

(21) Appl. No.: 11/305,510

(22) Filed: Dec. 16, 2005

(65) Prior Publication Data

US 2006/0133077 A1 Jun. 22, 2006

Related U.S. Application Data

(60) Provisional application No. 60/636,939, filed on Dec. 17, 2004.

(51) Int. Cl.
*F21S 4/00* (2006.01)
*H01R 33/08* (2006.01)

(52) U.S. Cl. ..... 362/219; 362/217; 362/225; 439/235

(58) Field of Classification Search ..... 362/219, 362/225, 249, 432; 439/235
See application file for complete search history.

(56) References Cited

U.S. PATENT DOCUMENTS 2,501,485 A * 3/1950 Tuck ..... 315/257
5,027,262 A 6/1991 Freed ..... 362/249
5,221,138 A 6/1993 Bostjancic et al. ..... 362/221
5,357,412 A 10/1994 Entrop et al. ..... 362/219
5,422,800 A 6/1995 Entrop et al. ..... 362/219
5,550,725 A 8/1996 Shemitz et al. ..... 362/282
5,751,117 A 5/1998 Abbott ..... 315/244
5,775,797 A 7/1998 Henstra ..... 362/225
6,048,220 A 4/2000 Altman et al. ..... 439/235
6,814,462 B1 * 11/2004 Fiene ..... 362/133
2004/0114361 A1 * 6/2004 Severtson et al. ..... 362/219
2004/0136187 A1 7/2004 Plunk et al. ..... 362/225

* cited by examiner

*Primary Examiner*—Ali Alavi
(74) *Attorney, Agent, or Firm*—Taylor & Aust, P.C.

(57) ABSTRACT

A lampholder assembly in which lampholders are supported on a bracket in a back-to-back configuration with no gap therebetween is formed of a pair of insulative lampholders, each having a generally planar back surface and an opposite front face including a lamp receiving opening. One lampholder includes a set of two resilient latching pawls extending generally orthogonally from and to either side of the back surface thereof and the other lampholder includes a set of two rigid bosses extending from laterally opposite sides thereof. A lampholder mounting bracket receives the bosses and latching pawls to rigidly support the lampholders in back-to-back contact with one another.

20 Claims, 4 Drawing Sheets

BACK-TO-BACK LAMPHOLDER

CROSS-REFERENCE TO RELATED APPLICATIONS

This application claims the benefit of U.S. Provisional Application No. 60/636,939 filed Dec. 17, 2004.

BACKGROUND OF THE INVENTION

1. Field of the Invention

The present invention relates to lampholders, for example, for elongated tubular fluorescent lamps, which facilitate the assembly of a plurality of lamps in an end-to-end relationship.

2. Description of the Related Art

Common fluorescent lamp bases or lampholders are frequently formed of an insulative housing containing a pair of contacts with a transverse slot in one lampholder face communicating with a cylindrical cavity to allow insertion of a pair of lamp contact pins and the connection of those pins to the internal contacts. A lamp is moved orthogonally to its direction of elongation and pairs of contact pins at opposite lamp ends are passed along the lampholder slots, and the tube subsequently rotated about its elongation axis to engage the pins with the internal contacts. The engagement is sufficiently resilient to retain the lamp in its pair of lampholders. A lampholder of this type is frequently fixed to a mounting plate and a pair of mounting plates and associated lampholders upstand from a common flat plate to receive a lamp. Two or more lamps may be mounted parallel to and adjacent one another and/or lamps may be concatenated to form a lengthy chain of lamps. In either case, two lampholders are usually employed for each elongated tubular lamp. In the case of a linear array of lamps, unless the lamps are staggered in some way, there is typically an air gap between adjacent lampholders, hence, lampholders and their associated hardware consume a considerable portion of the overall length of the array.

SUMMARY OF THE INVENTION

The present invention provides a method and apparatus of placing lampholders back to back in a vertical divider with no air gap. This facilitates assembling a longitudinally extending end-to-end linear array of lamps.

The invention comprises, in one form thereof, a method of and apparatus for concatenating a plurality of elongated fluorescent tubes in a longitudinally extending end-to-end assembly. First and last individual lampholders define the longitudinal extent of the concatenated assembly. Individual pairs of lampholders, each of a type having a contact receiving front face and a generally flat back surface are positioned intermediate the first and last lampholders. Each intermediate pair has respective back surfaces in contact and respective front faces spaced from and aligned with an adjacent lampholder front face to receive therebetween a fluorescent tube or similar lamp. In conjunction with a lampholder support bracket, the back of each lampholder of the pair engages the back of the other and aids in positioning and retaining the other of the pair within the assembly. Each lampholder pair comprises first and second dissimilar lampholders. The first lampholder of each pair includes latching pawls extending longitudinally beyond the back surface and the second lampholder of each pair includes laterally extending bosses, the pawls and bosses cooperate with the lampholder back surfaces to fix the location of the pair within the assembly. The lampholder support bracket has a generally flat body portion with a central opening for admitting a lampholder portion. A pair of arms extend generally orthogonally from the body portion, one to either side of and closely adjacent the central opening. There are a pair of snap fastener receiving openings in the body portion, one to either side of and closely adjacent the central opening for receiving lampholder retaining pawls and a pair of boss receiving openings, one in each arm, for receiving and retaining respective lampholder bosses.

An advantage of the present invention is that a smaller percent of a linear lamp array is consumed by lamp connector assemblies.

Another advantage is that the opening for the insertion of lamps, such as T8 lamps, is maximized also allowing the use of a smaller lamps with wires protruding less far.

A further advantage is the provision of a less expensive to produce and more easily assembled lampholder.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
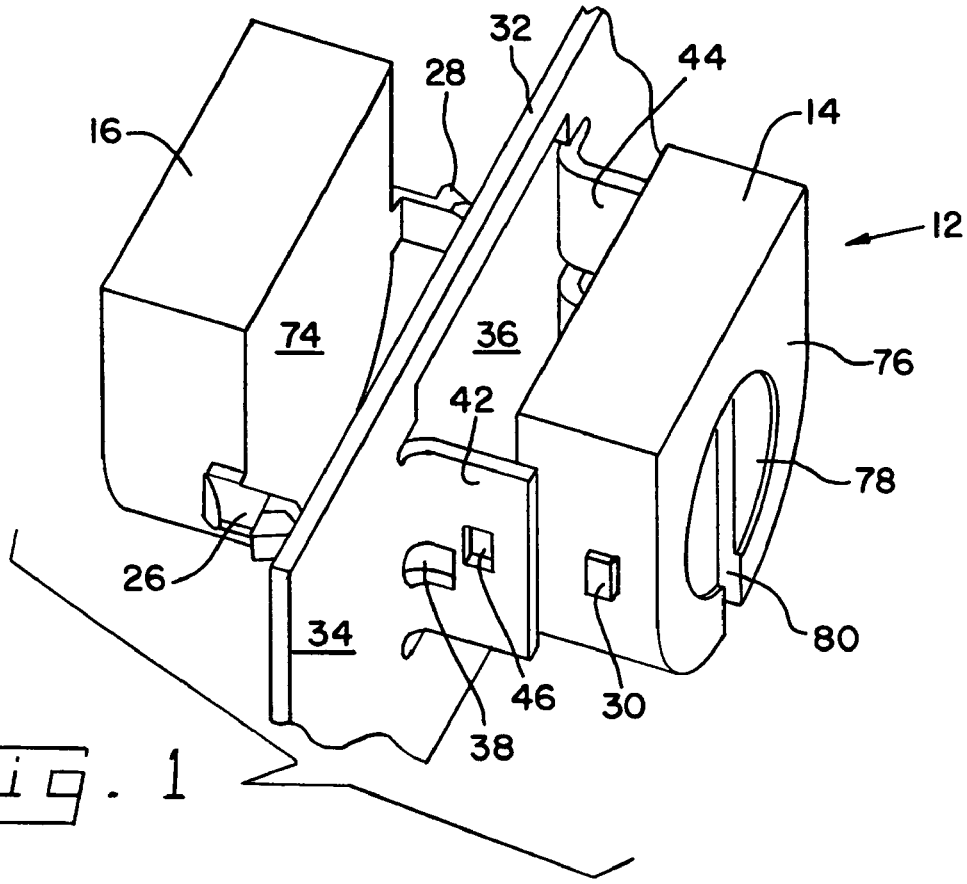
FIG. 1 is an exploded isometric view of a lampholder assembly with a back of a first lampholder and a front face of a second lampholder visible.
Figure 7:
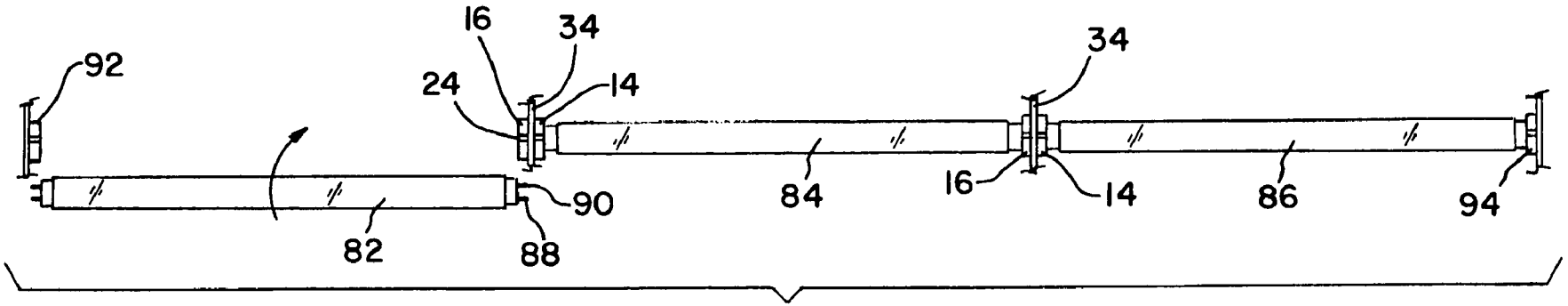
FIG. 7 is a bottom plan view of a portion of an overhead lighting fixture having a plurality of elongated fluorescent tubes in a longitudinally extending end-to-end assembly.

Referring now to the drawings and particularly to FIG. 1, there is shown a lampholder assembly 12 including a pair of lampholders 14 and 16 ready to be assembled on a bracket 32 in a back-to-back configuration. A front face 76 of lampholder 14 and a back surface 74 of lampholder 16 are visible. The front face 76 of lampholder 14 includes an opening or aperture 78 and a slot 80 providing limited access to the internal contacts of the lampholder by lamp contact pins such as 88 and 90 (FIG. 7). Lampholder 14 has a pair of laterally extending bosses 30 and another (not visible) on the side of lampholder 14 opposite boss 30. Lampholder 16 includes a pair of rearwardly extending latching pawls 26 and 28. The pawls, bosses and lampholder back surfaces cooperate with a mounting bracket 32 to maintain the lampholders in lamp receiving positions.

Figure 2:
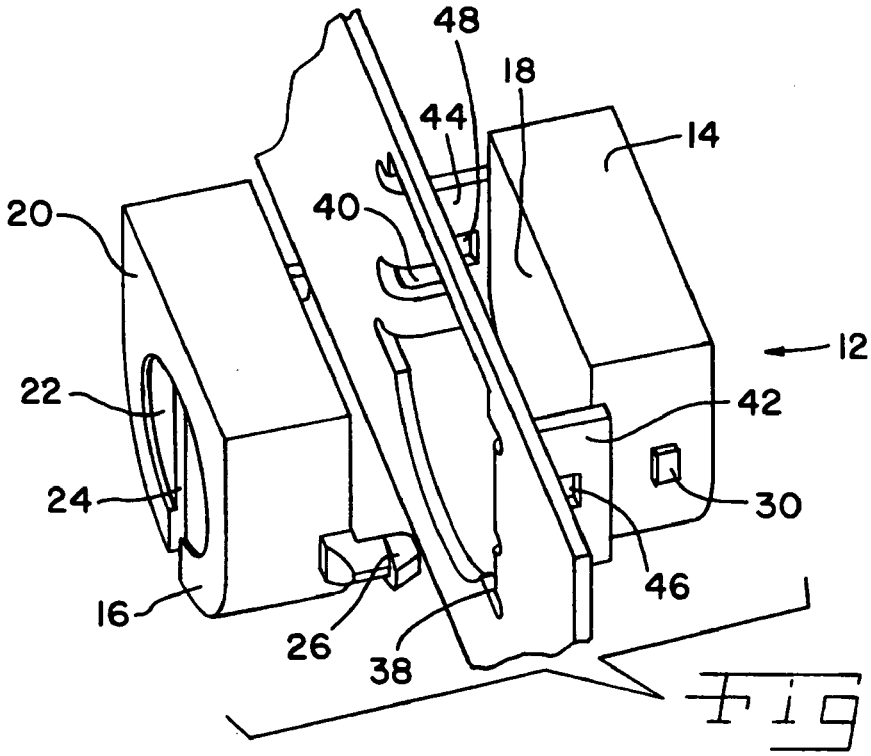
FIG. 2 is an exploded isometric view of the lampholder assembly of FIG. 1 with the front face of the first lampholder and the back surface of the second lampholder visible.

Comparing FIGS. 1 and 2, front face 20 of lampholder 16 and back surface 18 of lampholder 14 are visible in FIG. 2. The front face 20 of lampholder 16 includes an opening or aperture 22 and a slot 24 providing limited access to the internal contacts of the lampholder by lamp contact pins such as 88 and 90. The mounting bracket 32 includes a generally flat body 34 with a contoured central opening 36 to pass a lampholder portion. There is also a pair of latching pawl receiving openings 38 and 40 in the body portion 34 for receiving the latching pawls 26 and 28 of lampholder 16 as well as a pair of arms 42 and 44 extending one to either side of opening 36 perpendicularly from the body 34 to embrace lampholder 14. Each arm includes a boss receiving aperture 46 or 48 one to either side of and closely adjacent the central opening 36 for receiving and retaining the rigid bosses such as 30 of lampholder 14.

Figure 3:
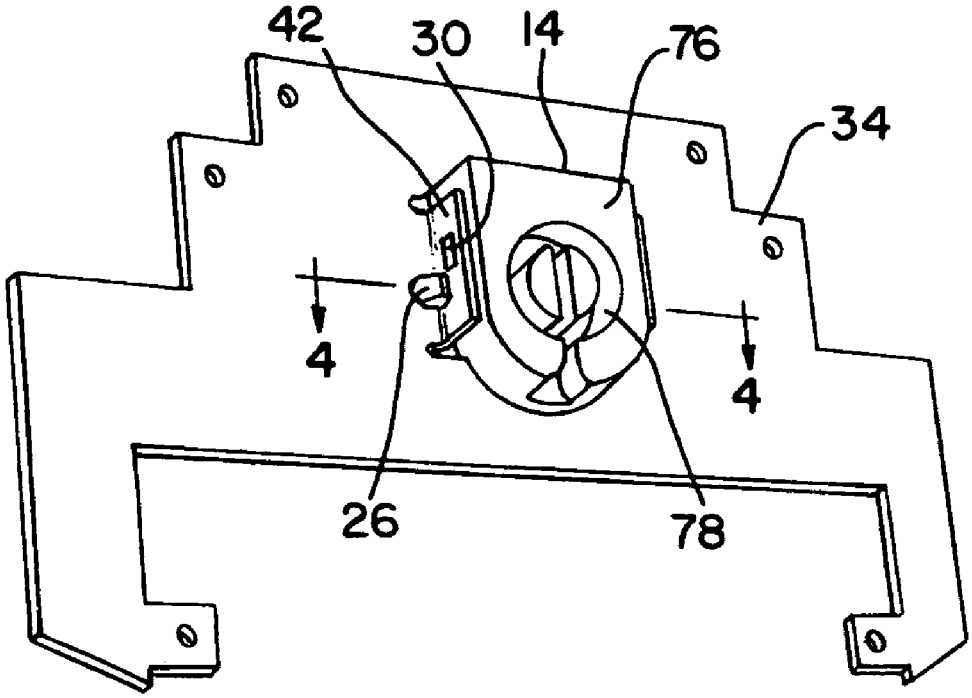
FIG. 3 is an isometric view of the lampholder assembly of FIGS. 1 and 2 in the assembled configuration.
Figure 4:
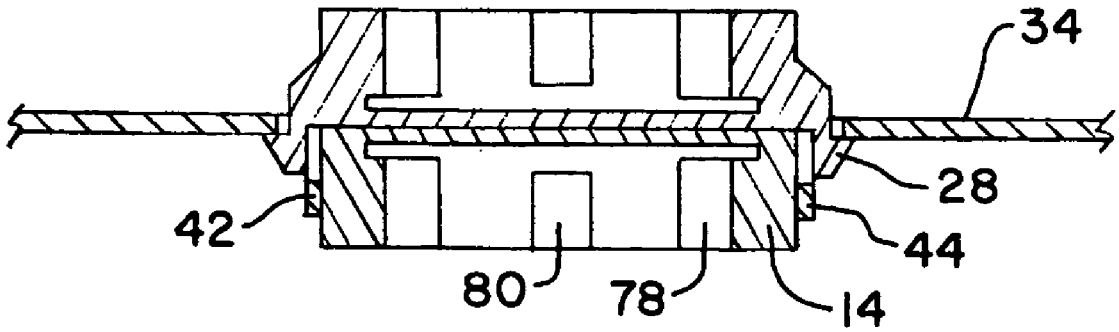
FIG. 4 is a cross-sectional view along the line 4-4 of FIG. 3

In FIG. 3, the lampholders 14 and 16 are in line with one another and, like the two faces of Janus, are facing in opposite directions. The process of assembling the lampholders 14 and 16 to the bracket 32 may begin with joining either of the dissimilar lampholders 14 or 16 to the bracket. For example, to join lampholder 14 to the bracket, the arms 42 and 44 are spread somewhat away from one another and the lampholder is moved toward the central opening 36 with the rear surface 18 being maintained generally parallel to the plane of the flat body portion 34. When the laterally extending bosses such as 30 are aligned with the boss receiving openings 46 and 48, the arms spring back toward one another securely gripping the lampholder. In its final position, the rear surface 18 may lie slightly to either side of or within the thickness of the body portion 34. Lampholder 16 is similarly moved toward the central opening 36 with the rear surface 74 being maintained generally parallel to the plane of the flat body portion 34. The latching tabs or pawls 26 and 28 are flexed somewhat toward one another as they pass into the pawl receiving openings 38 and 40 and then snap back outwardly to secure the lampholder in position with back surface 74 in contact with back surface 18 of the other lampholder. This back-to-back contact is most easily seen in FIG. 4. If lampholder 16 had been selected as the first to be assembled to the bracket, it would appear that the lampholder might be free to pass completely through the opening 36. There are many suitable ways to prevent this, but if lampholder 16 is assembled last, the back surface 18 of lampholder 14 limits its travel. Thus, as shown, the back of one lampholder of the pair aids in positioning and retaining the other of the pair within the assembly.

Figure 5:
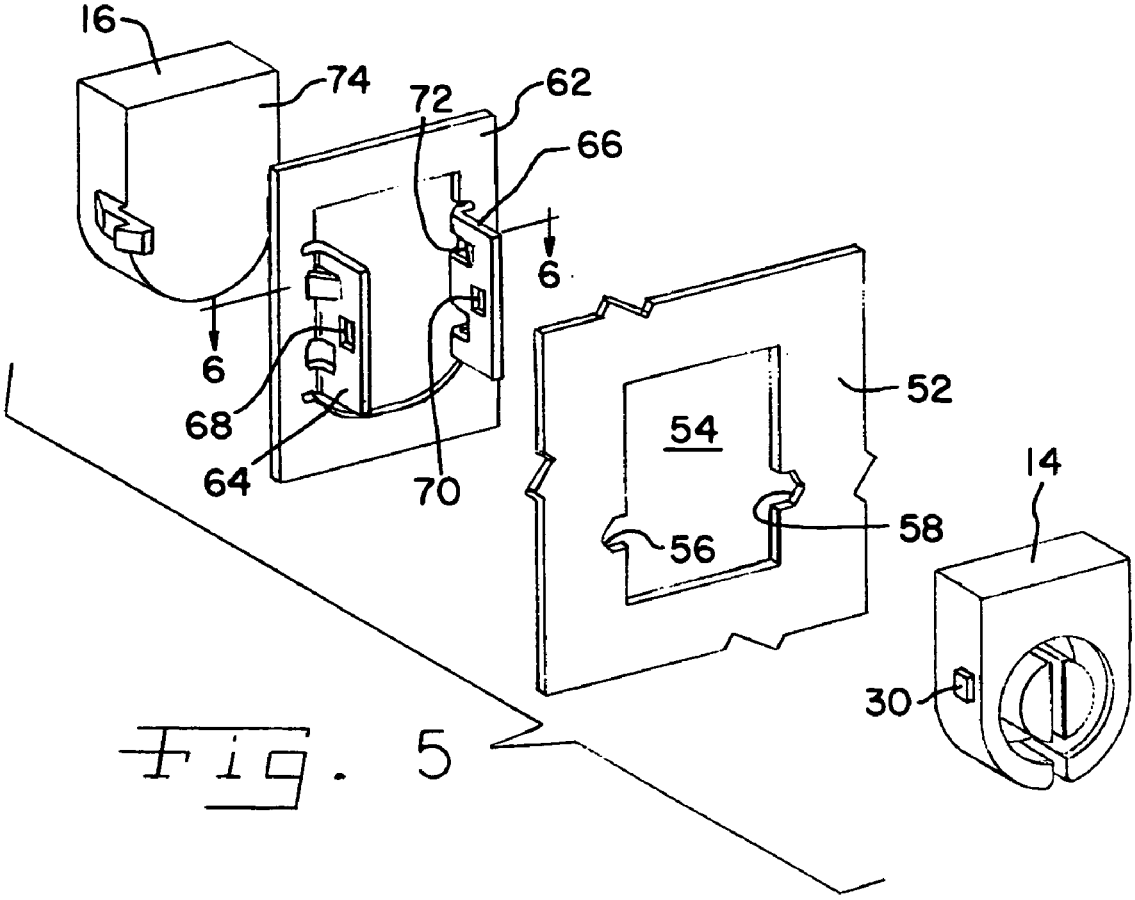
FIG. 5 is an exploded isometric view of a modified lampholder assembly.
Figure 6:
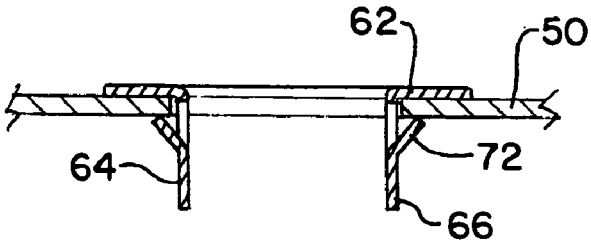
FIG. 6 is a cross-sectional view along line 6-6 of FIG. 5.

In FIGS. 1-4, the body portion 34 and arms 42 and 44 are formed by perforating and bending a single sheet of metal. In FIGS. 5 and 6 a modified support or mounting bracket 50 is made by joining two separately fabricated pieces. The body portion and arms comprise two separable components. The body portion 52 comprises an apertured sheet of metal and the arms 64 and 66 comprise a separate spring clip formed from a sheet of resilient metal and having a generally planar base portion 62 with a central opening for admitting a lampholder portion with the pair of resilient arms 64, 66 extending generally orthogonally from the base portion 62, one to either side of and closely adjacent the base portion central opening for receiving and retaining the rigid bosses of lampholder 14. The spring clip may be produced with a progressive die or 4 side and then inserted into the other bracket portion. The base portion 62 engages the body 52 on a first side thereof and the arms extend from a second side of the body as best seen in FIG. 6. The arms 64 and 66 include a set of locking tabs such as 72 for engaging the body second side (front surface in FIG. 5 and lower surface in FIG. 6) to rigidly join the apertured sheet of metal and sheet of resilient metal.

FIG. 7 illustrates application of the lampholder assembly 12 to create a concatenated plurality of elongated fluorescent tubes in a longitudinally extending end-to-end assembly. The lamps 82, 84 and 86 may be any suitable type, but are shown as T8 (one inch diameter tubular fluorescent) lamps of a desired length. A plurality of lampholders 14, 16 each of a type having a lanp contact receiving front face and a generally flat back surface are assembled to corresponding brackets 34 as described earlier and are located relative to one another in a lighting assembly (not shown). First and last individual lampholders 92 and 94 are positioned to define the longitudinal extent of the concatenated assembly with the pairs of individual lampholders 14, 16 positioned intermediate the first and last lampholders. As described earlier, each intermediate pair 14 and 16 have respective back surfaces in contact. The respective front faces are spaced from and aligned with an adjacent lampholder front face to receive therebetween a fluorescent tube. As shown in FIG. 7, lamps 84 and 86 are already positioned between respective lampholder front faces while lamp 82 is positioned preparatory to having pins such as 88 and 90 introduced into slots such as 24. Lamp 82 is translated upwardly as viewed engaging both sets of pins in corresponding slots whereupon the lamp is rotated about ninety degrees about its axis of elongation to make electrical contact and retain the lamp between the lampholders. Either of the single end lampholders 92 or 94 may be of a type having latching pawls, a type having lateral bosses as described earlier, or may be of a more conventional design.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lampholder assembly, comprising:

a pair of insulative lampholders, each having a generally planar back surface and an opposite front face including a lamp receiving opening; one lampholder including a set of resilient latching pawls and the other lampholder including a set of rigid bosses, and a lampholder mounting bracket for receiving the bosses and latching pawls to rigidly support the lampholders in back-to-back contact with one another.

2. The lampholder assembly of claim 1, wherein there are two latching pawls extending generally orthogonally from and to either side of the back surface of said one lampholder.

3. The lampholder assembly of claim 2, wherein the mounting bracket includes a generally flat body with a central opening contoured to pass a lampholder portion, a pair of latching pawl receiving openings in the body portion for receiving the latching pawls of said one lampholder, and pair of arms extending from the body to embrace said other lampholder.

4. The lampholder assembly of claim 1, wherein there are two bosses extending from laterally opposite sides of said other lampholder.

5. The lampholder assembly of claim 4, further including pair of arms extending from the body to embrace said other lampholder, each arm including a boss receiving aperture.

6. The lampholder assembly of claim 1, wherein the mounting bracket includes a generally flat body portion having a central opening for admitting a lampholder portion and a pair of arms extending generally orthogonally from the body portion, one to either side of and closely adjacent the central opening for receiving and retaining the rigid bosses of said other lampholder.

7. The lampholder assembly of claim 6, further comprising a set of openings in the body portion spaced about the central opening for receiving corresponding ones of the latching pawls.

8. The lampholder assembly of claim 6, wherein the body portion and arms are formed by perforating and bending a sheet of metal.

9. The lampholder assembly of claim 6, wherein the body portion and arms comprise two separable components.

10. The lampholder assembly of claim 6, wherein the body portion comprises an apertured sheet of metal and the arms comprise a separate sheet of resilient metal having a generally planar base portion with a central opening for admitting a lampholder portion and a pair of resilient arms extending generally orthogonally from the base portion, one to either side of and closely adjacent the base portion central opening for receiving and retaining the rigid bosses of said other lampholder.

11. The lampholder assembly of claim 10, wherein the base portion engages the body on a first side thereof and the arms extend from a second side of the body, the arms including a set of locking tabs for engaging the body second side to rigidly join the apertured sheet of metal and sheet of resilient metal.

12. A lampholder support bracket, comprising:

a generally flat body portion having a central opening for admitting a lampholder portion;

a pair of arms extending generally orthogonally from the body portion, one to either side of and closely adjacent the central opening;

a pair of snap fastener receiving openings in the body portion, one to either side of and closely adjacent the central opening for receiving and retaining corresponding lampholder latching pawls;

a pair of boss receiving openings, one in each arm, for receiving and retaining respective lampholder bosses.

13. The lampholder support bracket of claim 12, wherein the body portion comprises an apertured sheet of metal and the arms comprise a separate sheet of resilient metal having a generally planar base portion with a central opening for admitting a lampholder portion and a pair of resilient arms extending generally orthogonally from the base portion, one to either side of and closely adjacent the base portion central opening for embracing a lampholder.

14. The lampholder support bracket of claim 13, wherein the base portion engages the body on a first side thereof and the arms extend from a second side of the body, the arms including a set of locking tabs for engaging the body second side to rigidly join the apertured sheet of metal and sheet of resilient metal.

15. A method of concatenating a plurality of elongated fluorescent tubes in a longitudinally extending end-to-end assembly, comprising:

assembling a plurality of lampholders, each of a type having a contact receiving front face and a generally flat back surface, including positioning first and last individual lampholders defining the longitudinal extent of the concatenated assembly, and positioning pairs of individual lampholders intermediate the first and last lampholders, each intermediate pair having respective back surfaces in contact and respective front faces spaced from and aligned with an adjacent lampholder front face to receive therebetween a fluorescent tube.

16. The method of claim 15, wherein the back of each lampholder of the pair aids in positioning and retaining the other of the pair within the assembly.

17. The method of claim 15, wherein each lampholder pair comprises first and second dissimilar lampholders.

18. The method of claim 17, wherein the back of one lampholder of the pair aids in positioning and retaining the other of the pair within the assembly.

19. The method of claim 17, wherein the first lampholder of each pair includes latching pawls extending longitudinally beyond the back surface and the second lampholder of each pair includes laterally extending bosses, the pawls and bosses cooperating with the lampholder back surfaces to fix the location of the pair within the assembly.

20. The method of claim 17, wherein the step of assembling further includes providing a mounting bracket, the pawls and bosses additionally cooperating with the mounting bracket to fix the location of the pair within the assembly.

* * * * *